US009092009B2

(12) United States Patent
Kondo

(10) Patent No.: US 9,092,009 B2
(45) Date of Patent: Jul. 28, 2015

(54) IMAGE FORMING APPARATUS WITH NATURAL VENTILATOR

(75) Inventor: Kazuyoshi Kondo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 13/610,120

(22) Filed: Sep. 11, 2012

(65) Prior Publication Data

US 2013/0108308 A1 May 2, 2013

(30) Foreign Application Priority Data

Oct. 28, 2011 (JP) ..... 2011-237661

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
USPC ..... 399/91, 92, 124; 454/195
See application file for complete search history.

(56) References Cited

U.S. PATENT DOCUMENTS

2008/0253796 A1 10/2008 Idehara et al.

FOREIGN PATENT DOCUMENTS

JP 8-129280 5/1996
JP 2010-097036 4/2010

*Primary Examiner* — Erika J Villaluna
(74) *Attorney, Agent, or Firm* — Harness, Dickey & Pierce, P.L.C.

(57) ABSTRACT

An image forming apparatus includes an outside air inlet created between a cover and a body plate, through which outside air is taken in. A vent is created between the body plate and the cover. The outside air taken in through the outside air inlet travels through an air current channel upward to the vent in an outside air traveling direction. At least one hot air outlet is produced through the body plate at a position between the outside air inlet and the vent in the outside air traveling direction. Hot air is discharged into the air current channel through the at least one hot air outlet. The outside air taken in through the outside air inlet is mixed with the hot air discharged through the at least one hot air outlet and is exhausted through the vent.

6 Claims, 6 Drawing Sheets

IMAGE FORMING APPARATUS WITH NATURAL VENTILATOR

CROSS-REFERENCE TO RELATED APPLICATION

This patent application is based on and claims priority pursuant to 35 U.S.C. §119 to Japanese Patent Application No. 2011-237661, filed on Oct. 28, 2011, in the Japanese Patent Office, the entire disclosure of which is hereby incorporated by reference herein.

BACKGROUND OF THE INVENTION

1. Field of the Invention

Example embodiments generally relate to an image forming apparatus, and more particularly, to an image forming apparatus including a natural ventilator for exhausting hot air to the outside of the image forming apparatus.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such image forming apparatuses may employ a fixing device incorporating a fixing roller heated by a heater and an opposed pressing roller pressed against the fixing roller to form a fixing nip therebetween. As a recording medium bearing a toner image is conveyed through the fixing nip, the fixing roller and the pressing roller apply heat and pressure to the recording medium, melting and fixing the toner image on the recording medium. Since heat conducted from the fixing device may melt developer contained in the development device or cause malfunction of the peripheral components of the fixing device, the image forming apparatus may incorporate a natural ventilator that exhausts hot air from the fixing device to the outside of the image forming apparatus.

For example, the natural ventilator may include a plurality of hot air outlets through which hot air from the fixing device is discharged. The hot air outlets penetrate a body plate disposed opposite a cover of the image forming apparatus produced with a plurality of outside air inlets penetrating the cover. As outside air enters the image forming apparatus through the outside air inlets, the hot air discharged through the hot air outlets is mixed with the outside air, travels upward through an air current channel extending from the outside air inlets to a vent situated at an upper edge of the cover, and is exhausted through the vent to the outside of the image forming apparatus.

The natural ventilator may require lots of hot air outlets that may degrade the appearance of the image forming apparatus. To address this problem, the cover is disposed opposite the hot air outlets to screen them from the user. However, the cover screening the hot air outlets may decrease ventilation efficiency and overheat itself.

Further, since the air current channel that conveys outside air upward to the vent is created between the cover and the body plate produced with the hot air outlets, as outside air horizontally enters the air current channel through the outside air inlets penetrating the cover, the outside air may not move vertically through the air current channel smoothly and therefore may not cool the cover heated by hot air discharged through the hot air outlets.

SUMMARY OF THE INVENTION

At least one embodiment may provide an image forming apparatus that includes a body plate, a cover disposed opposite the body plate, and an orthogonal plate projecting from a lower edge of the cover orthogonally toward the body plate. An outside air inlet is created between the orthogonal plate and the body plate, through which outside air is taken in. A vent is created between the body plate and the cover at an upper edge of the cover. An air current channel is in communication with the outside air inlet and the vent. The outside air taken in through the outside air inlet travels through the air current channel upward to the vent in an outside air traveling direction. At least one hot air outlet is produced through the body plate at a position between the outside air inlet and the vent in the outside air traveling direction. Hot air is discharged into the air current channel through the at least one hot air outlet. The outside air taken in through the outside air inlet is mixed with the hot air discharged through the at least one hot air outlet and is exhausted through the vent.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
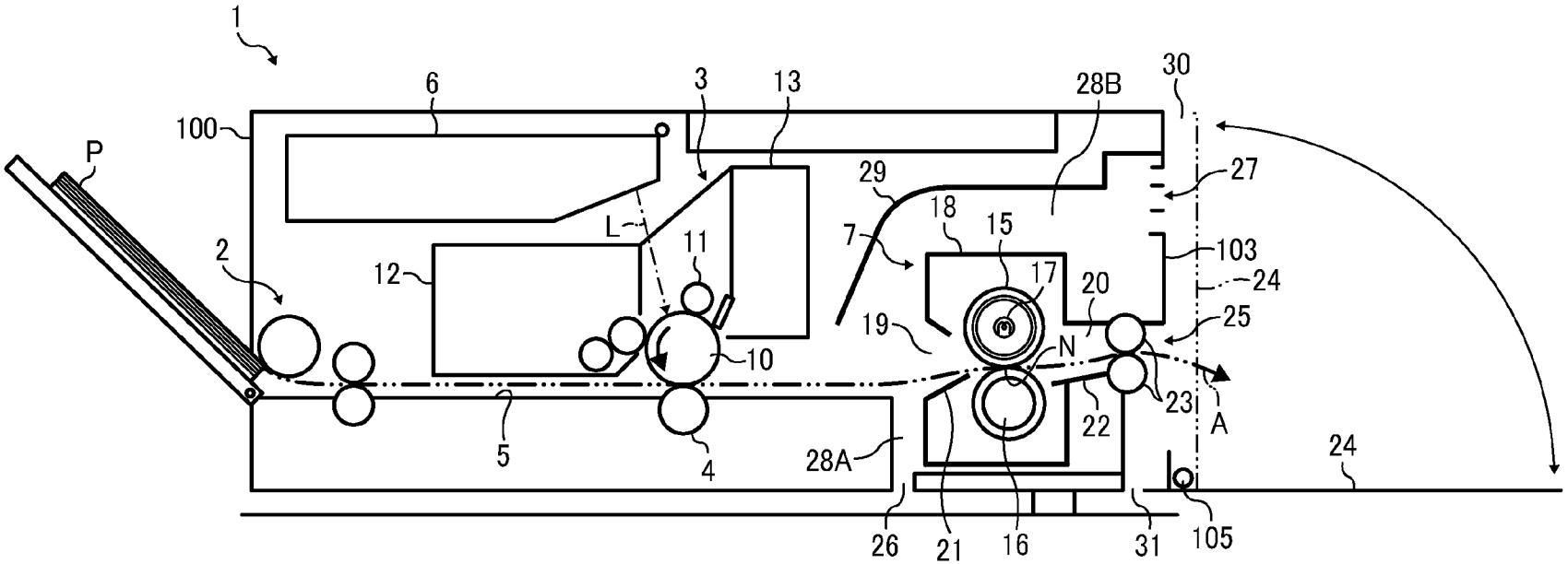
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction printer having at least one of copying, printing, scanning, plotter, and facsimile functions, or the like. According to this example embodiment, the image forming apparatus 1 is a laser printer for forming a monochrome toner image on a recording medium by electrophotography.

With reference to FIG. 1, a description is provided of a structure of the image forming apparatus 1.

The image forming apparatus 1 includes a body 100 attached with a sheet feeder 2 at one side thereof, that is, a left side in FIG. 1. The sheet feeder 2 loads a plurality of sheets P serving as recording media and feeds an uppermost sheet P toward a process unit 3 located at a center portion inside the body 100. The process unit 3 serves as an image forming unit that forms a toner image using developer containing toner. Below the process unit 3 are a transfer roller 4 and a conveyance guide 5. The transfer roller 4 serves as a transferor that transfers the toner image formed by the process unit 3 onto the sheet P supplied from the sheet feeder 2. The conveyance guide 5 supports and guides the sheet P conveyed from the sheet feeder 2 toward the transfer roller 4, thus facilitating conveyance of the sheet P in a horizontal direction. Additionally, the conveyance guide 5 supports the sheet feeder 2 and the transfer roller 4. Above the process unit 3 is an exposure device 6 that emits a laser beam L onto the process unit 3 to form an electrostatic latent image thereon.

In proximity to another side of the body 100, that is, a right side in FIG. 1, is a fixing device 7 that fixes the toner image on the sheet P conveyed from the transfer roller 4. Thus, the sheet P is conveyed from the sheet feeder 2 to the fixing device 7 on a conveyance path A indicated by the broken line in FIG. 1 for formation of the toner image on the sheet P.

A detailed description is now given of a construction of the process unit 3.

The process unit 3 includes a photoconductive drum 10 serving as an image carrier that carries an electrostatic latent image formed by the exposure device 6 and a resultant toner image and is surrounded by a charger 11, a development device 12, a cleaner 13, and a discharger. The photoconductive drum 10, the charger 11, the development device 12, the cleaner 13, and the discharger are integrated into the replaceable process unit 3 detachably attached to the body 100. Thus, the process unit 3 is readily replaced with a new one when it is at the end of its safe useful life.

A detailed description is now given of a construction of the fixing device 7.

The fixing device 7 includes a fixing roller 15 serving as a fixing rotary body; a pressing roller 16 serving as an opposed rotary body disposed opposite the fixing roller 15; and a heater 17 situated inside the fixing roller 15 to heat the fixing roller 15. The pressing roller 16 is pressed against the fixing roller 15 to form a fixing nip N therebetween through which the sheet P bearing the toner image is conveyed. A casing 18 constituting an exterior of the fixing device 7 houses the fixing roller 15 and the pressing roller 16. The casing 18 includes an entry 19 through which the sheet P bearing the toner image enters the fixing device 7 and an exit 20 through which the sheet P is discharged from the fixing device 7. The entry 19 is provided with an entry guide 21 that guides the sheet P bearing the toner image to the fixing nip N formed between the fixing roller 15 and the pressing roller 16. The entry guide 21 is applied with fluoridation surface treatment that decreases frictional resistance between the entry guide 21 and the sheet P sliding over the entry guide 21 and at the same time facilitates removal of toner scattered from the toner image on the sheet P onto the entry guide 21. The exit 20 is provided with an exit guide 22 that guides the sheet P bearing the fixed toner image toward an outside of the fixing device 7, that is, an output roller pair 23 that discharges the sheet P conveyed from the exit guide 22 onto an outside of the body 100.

The right side in FIG. 1 of the body 100 is a front of the image forming apparatus 1 that faces a user who operates the image forming apparatus 1. The right side of the body 100 is attached with a front cover 24. The front cover 24 is pivotable about a shaft 105 mounted on a lower part of the body 100 below a sheet outlet 25 serving as a recording medium outlet in such a manner that the front cover 24 is openable from and closable to the body 100. For example, when the image forming apparatus 1 is in operation, the front cover 24 is opened at an open position indicated by the solid line in FIG. 1. Conversely, when the image forming apparatus 1 is not in operation, the front cover 24 is closed at a close position indicated by the broken line in FIG. 1.

The fixing roller 15 is constructed of a pipe-shaped metal core and a release layer coating the metal core and made of tetrafluoroethylene-perfluoroalkyl vinyl ether copolymer (PFA). The pressing roller 16 is an elastic roller constructed of a metal core; an elastic layer coating the metal core and made of silicone rubber; and a release layer coating the elastic layer and made of PFA. A pressurization assembly presses the pressing roller 16 against the fixing roller 15 with predetermined pressure to form the fixing nip N therebetween having a length of about 4 mm in a sheet conveyance direction. A thermistor serving as a temperature detector contacts an outer circumferential surface of the fixing roller 15 and detects the temperature of the fixing roller 15. A controller, that is, a central processing unit (CPU) provided with a random-access memory (RAM) and a read-only memory (ROM), for example, is operatively connected to the thermistor and the heater 17 to control the heater 17 based on the temperature of the fixing roller 15 detected by the thermistor, thus adjusting the temperature of the fixing roller 15 in a range of from about 155 degrees centigrade to about 165 degrees centigrade.

The construction of the fixing device 7 is not limited to that described above. For example, according to this example embodiment, the fixing roller 15 serves as a fixing rotary body and the pressing roller 16 serves as an opposed rotary body. Alternatively, at least one of the fixing rotary body and the opposed rotary body may be an endless belt and a roller or a pad disposed inside the endless belt may press the endless belt against another one of the fixing rotary body and the opposed rotary body. Further, according to this example embodiment, the pressing roller 16 is pressed against the fixing roller 15. Alternatively, the pressing roller 16 may merely contact the fixing roller 15.

With reference to FIG. 1, a description is provided of an operation of the image forming apparatus 1 having the structure described above to form a toner image on a sheet P.

As the image forming apparatus 1 receives a print job from an external device such as a client computer, a driver (e.g., a motor) drives and rotates the photoconductive drum 10 counterclockwise in FIG. 1 through a transmission (e.g., a gear train) connected to a shaft of the photoconductive drum 10. As a charging roller incorporated in the charger 11 rotates in accordance with rotation of the photoconductive drum 10 by friction therebetween, a high voltage power supply applies a charging voltage to the charging roller so that the charging roller uniformly charges an outer circumferential surface of the photoconductive drum 10. The exposure device 6 situated above the process unit 3 emits a laser beam L onto the charged outer circumferential surface of the photoconductive drum 10 according to image data contained in the print job, thus forming an electrostatic latent image thereon. As the electrostatic latent image formed on the photoconductive drum 10 travels under the development device 12, the development device 12 supplies toner to the electrostatic latent image, visualizing the electrostatic latent image as a toner image. As the toner image formed on the photoconductive drum 10 travels through a transfer nip where the photoconductive drum 10 is disposed opposite the transfer roller 4, the transfer roller 4 transfers the toner image from the photoconductive drum 10 onto a sheet P conveyed from the sheet feeder 2. For example, the high voltage power supply applies a transfer bias to the transfer roller 4 to create a transfer electric field that electrostatically transfers the toner image formed on the photoconductive drum 10 onto the sheet P.

After the transfer of the toner image onto the sheet P, the cleaner 13 removes residual toner not transferred onto the sheet P and therefore remaining on the photoconductive drum 10 therefrom. Thereafter, the discharger discharges the outer circumferential surface of the photoconductive drum 10, removing residual electric potential from the photoconductive drum 10. Thus, the outer circumferential surface of the photoconductive drum 10 is initialized to be ready for the next image forming operation.

The sheet P bearing the toner image transferred from the photoconductive drum 10 is conveyed to the fixing device 7 disposed downstream from the transfer roller 4 in the sheet conveyance direction. For example, the entry guide 21 guides the sheet P to the fixing nip N where the fixing roller 15 and the pressing roller 16 apply heat and pressure to the sheet P, thus melting and fixing the toner image on the sheet P. The sheet P bearing the fixed toner image is guided by the exit guide 22 to the sheet outlet 25 that brings an interior of the body 100 into communication with an exterior of the body 100. The output roller pair 23 disposed upstream from the sheet outlet 25 in the sheet conveyance direction discharges the sheet P onto the outside of the body 100, that is, onto the front cover 24 opened at the open position indicated by the solid line in FIG. 1.

Figure 2:
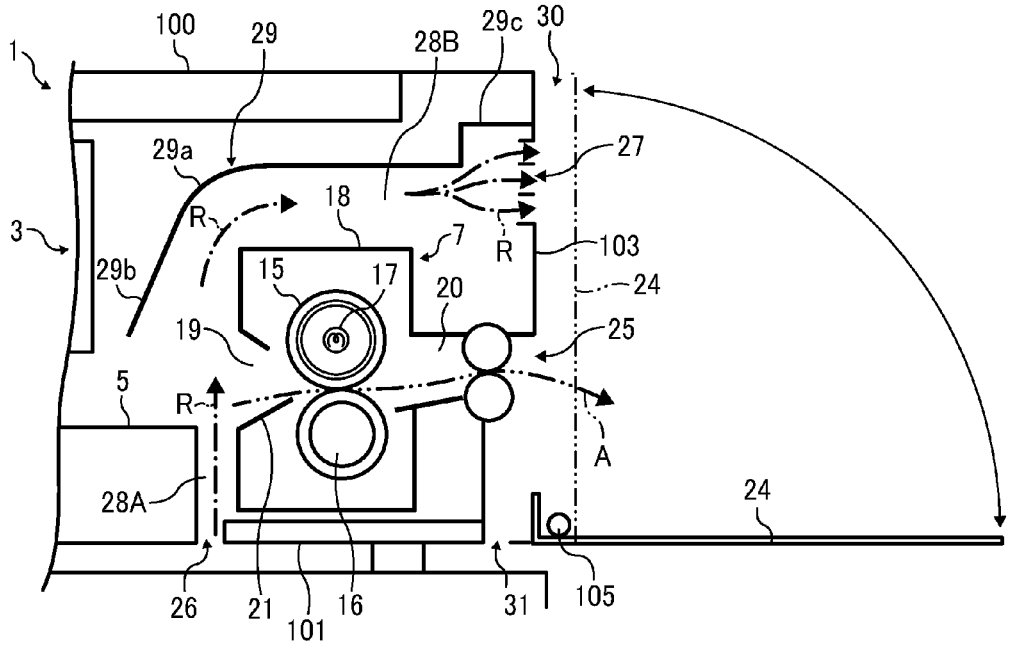
FIG. 2 is a partial vertical sectional view of the image forming apparatus shown in FIG. 1 in a state in which a front cover incorporated therein is opened.

With reference to FIG. 2, a description is provided of a configuration of a natural ventilator incorporated in the body 100.

FIG. 2 is a partial vertical sectional view of the image forming apparatus 1 in a state in which the front cover 24 is opened. As shown in FIG. 2, a bottom plate 101 of the body 100 is provided with an outside air intake 26 through which outside air, that is, ambient air, enters the body 100 from the outside of the body 100. Conversely, a front plate 103, serving as a body plate, of the body 100 is provided with at least one hot air outlet 27 through which hot air heated by the fixing device 7 goes out of the body 100. The outside air intake 26 is situated below the entry 19 of the fixing device 7 to take in outside air from below the bottom plate 101. Above the outside air intake 26 is an air current channel 28A in communication with the outside air intake 26 to guide outside air taken in through the outside air intake 26 to the entry 19 of the fixing device 7. Since the conveyance guide 5 is spaced apart from the fixing device 7 to create an interval therebetween that constitutes the air current channel 28A through which outside air taken in through the outside air intake 26 travels without being blocked by the conveyance guide 5.

The hot air outlet 27 is produced through the front plate 103 at a position above the fixing device 7. The air current channel 28A is in communication with an air current channel 28B situated above the fixing device 7. The air current channel 28B is in communication with the hot air outlet 27 at a downstream end thereof in an airflow direction R. A thermal shield 29 is interposed between the fixing device 7 and the process unit 3 to divide space therebetween into two compartments. The thermal shield 29 is a plate having a bent portion 29*a*. The bent portion 29*a* constitutes a smooth arcuate or arc-shaped face. The thermal shield 29 further includes an upstream end 29*b* disposed upstream from the bent portion 29*a* in the airflow direction R, which shields at least space above the entry 19 of the fixing device 7. The air current channel 28B is sandwiched between the casing 18 of the fixing device 7 and the thermal shield 29.

With reference to FIG. 2, a description is provided of airflow inside the body 100 of the image forming apparatus 1.

The airflow inside the body 100 is indicated by the arrows R. Since the temperature of the fixing roller 15 is maintained in a range of from about 155 degrees centigrade to about 165 degrees centigrade, heat from the fixing roller 15 overheats the components situated inside the body 100, for example, the process unit 3 and the exposure device 6 depicted in FIG. 1 situated in proximity to the fixing device 7. As hot air heated by the fixing roller 15 moves upward above the fixing device 7, an upward air current exerts negative pressure to surroundings of the fixing device 7. The negative pressure takes in outside air from the outside of the body 100 into the inside of the body 100 through the outside air intake 26 produced through the bottom plate 101. The outside air travels through the air current channel 28A sandwiched between the conveyance guide 5 and the fixing device 7 to the entry 19 of the fixing device 7.

As the outside air travels through the entry 19 of the fixing device 7, it moves hot air heated by the fixing roller 15 and discharged from the entry 19 toward the air current channel 28B. Accordingly, the hot air travels through the air current channel 28B to the hot air outlet 27 where the hot air is exhausted to the outside of the body 100. For example, the hot air discharged from the entry 19 of the fixing device 7 is mixed with outside air moving upward through the air current channel 28A and moves upward, impinging on the thermal shield 29. Hence, the hot air is guided by the thermal shield 29 toward a downstream end 29*c* thereof disposed downstream from the bent portion 29*a* in the airflow direction R. Specifically, the bent portion 29*a* of the thermal shield 29 changes the airflow direction R from a vertical direction to a horizontal direction, thus directing the hot air discharged from the entry 19 of the fixing device 7 toward the hot air outlet 27.

As described above, the negative pressure exerted by the upward air current generated by the heated fixing roller 15 takes in outside air from the outside of the body 100 through the outside air intake 26. Accordingly, even without a forced ventilator such as a ventilation fan or a cooling fan, outside air, mixed with hot air from the fixing device 7, travels through the air current channels 28A and 28B in the airflow direction R and therefore hot air discharged from the entry 19 of the fixing device 7 is exhausted through the hot air outlet 27.

Figure 3:
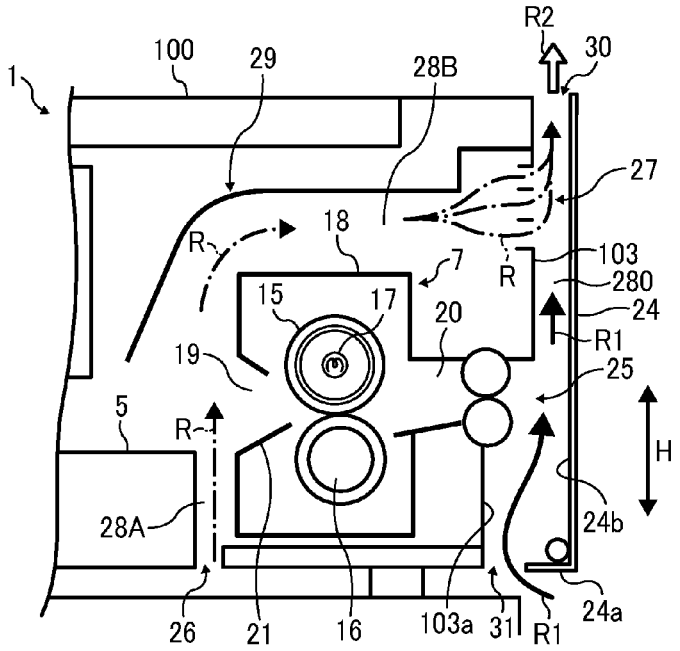
FIG. 3 is a partial vertical sectional view of the image forming apparatus shown in FIG. 1 in a state in which the front cover is closed.

With reference to FIG. 3, a description is provided of a configuration of the components disposed in proximity to the hot air outlet 27 and a configuration of the front cover 24.

FIG. 3 is a partial vertical sectional view of the image forming apparatus 1 in a state in which the front cover 24 is closed. When the front cover 24 is closed as shown in FIG. 3, the sheet outlet 25 and the hot air outlet 27 produced through the front plate 103 are not exposed to the user, enhancing the appearance of the image forming apparatus 1. The hot air exhausted through the hot air outlet 27 is further exhausted to the outside of the image forming apparatus 1 through a vent 30 created between the front plate 103 and the closed front cover 24 at an upper edge of the front cover 24. However, the curved air current channel 28B may decrease exhaust efficiency and the hot air exhausted through the hot air outlet 27 may increase the temperature of the front cover 24 and the front plate 103.

To address these problems, an orthogonal plate 24*a* mounted on a lower edge of the front cover 24 projects from the front cover 24 orthogonally toward the front plate 103 when the front cover 24 is closed. Accordingly, an outside air inlet 31 is created between the orthogonal plate 24*a* and the front plate 103. For example, the outside air inlet 31 is situated below the hot air outlet 27, that is, upstream from the hot air outlet 27 in an outside air traveling direction R1, thus abutting the front plate 103. Since the hot air discharged through the hot air outlet 27 moves upward, an upward air current generates negative pressure at a position in proximity to the hot air outlet 27. Accordingly, outside air enters the image forming apparatus 1 through the outside air inlet 31 and moves upward in the outside air traveling direction R1 through an air current channel 280 sandwiched between the front plate 103 and the front cover 24.

For example, the air current channel 280 is sandwiched between an exterior face 103*a* of the front plate 103 and an interior face 24*b* of the front cover 24 and extends vertically in a vertical direction H. Both ends of the air current channel 280 in the vertical direction H are in communication with the outside of the image forming apparatus 1. Hence, outside air enters the image forming apparatus 1 through the outside air inlet 31, moves upward in the outside air traveling direction R1 through the air current channel 280, and reaches the hot air outlet 27 where the outside air is mixed with and moves hot air discharged through the hot air outlet 27 upward to the vent 30. Thus, the hot air mixed with the outside air is exhausted through the vent 30 in an exhaust direction R2 to the outside of the image forming apparatus 1.

As described above, the negative pressure generated by the upward air current of the hot air discharged through the hot air outlet 27 takes in outside air through the outside air inlet 31. The outside air travels through the vertical air current channel 280 and moves the hot air discharged through the hot air outlet 27 upward to the vent 30 through which the hot air is exhausted to the outside of the image forming apparatus 1. Accordingly, the hot air discharged through the hot air outlet 27 moves smoothly toward the vent 30 compared to a configuration in which an outside air inlet penetrating the front cover 24 takes in outside air from the outside of the image forming apparatus 1. Consequently, the hot air is exhausted through the vent 30 efficiently. Further, the outside air inlet 31 is created between the front plate 103 produced with the hot air outlet 27 and the orthogonal plate 24*a* orthogonal to the front cover 24, causing the outside air to move along the exterior face 103*a* of the front plate 103 in the outside air traveling direction R1 and therefore minimizing temperature increase of the front plate 103.

If a comparative outside air inlet penetrates the front cover 24 instead of being provided between the front plate 103 and the orthogonal plate 24*a* like the outside air inlet 31 shown in FIG. 3, although outside air is taken in through the comparative outside air inlet penetrating the front cover 24 into the air current channel 280, the outside air enters the air current channel 280 horizontally, that is, in a direction orthogonal to the vertical direction H in which the air current channel 280 extends. That is, the comparative outside air inlet penetrating the front cover 24 may take in outside air in the horizontal direction shifted by about 90 degrees with respect to the vertical direction H in which the outside air inlet 31 shown in FIG. 3 takes in outside air. Accordingly, outside air may not be taken in through the comparative outside air inlet penetrating the front cover 24 smoothly and therefore may not move through the air current channel 280 efficiently. For example, outside air taken in through the comparative outside air inlet penetrating the front cover 24 may impinge on the front plate 103 and therefore may not convey hot air discharged through the hot air outlet 27 toward the vent 30 smoothly. Consequently, hot air discharged through the hot air outlet 27 may not be exhausted through the vent 30 efficiently. As a result, the hot air may stay in an upper portion of the air current channel 280, overheating the front cover 24.

To address this problem, the outside air inlet 31 and the vent 30 serving as an air outlet are provided at both ends of the air current channel 280 in the vertical direction H, respectively. That is, two intervals through which outside air is taken in and exhausted are provided at both ends of the front cover 24 in the vertical direction H, respectively. Outside air enters the air current channel 280 in the vertical direction H in which the air current channel 280 extends. Accordingly, the outside air is not blocked by the front plate 103 upon entry to the air current channel 280. Thereafter, the outside air moves smoothly through the air current channel 280 substantially vertically in the outside air traveling direction R1, moving hot air discharged through the hot air outlet 27 toward the vent 30. Consequently, the hot air discharged through the hot air outlet 27 does not overheat the front cover 24 and the front plate 103.

Figure 4:
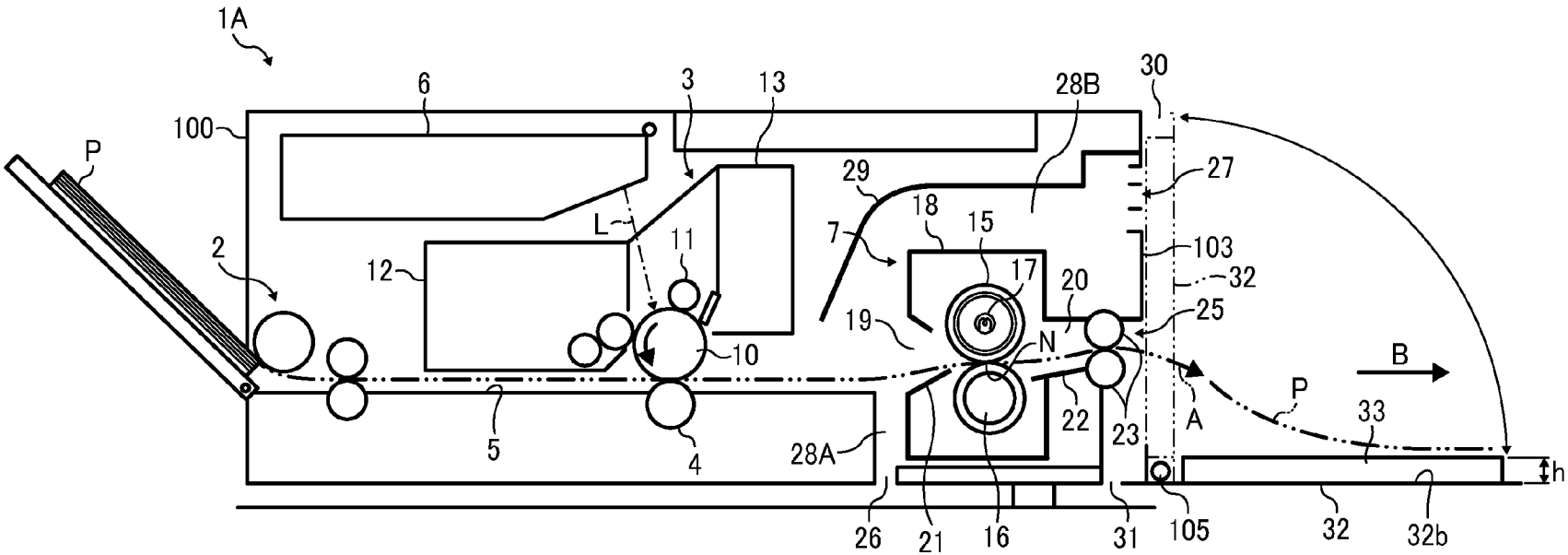
FIG. 4 is a schematic vertical sectional view of an image forming apparatus according to another example embodiment of the present invention.
Figure 5:
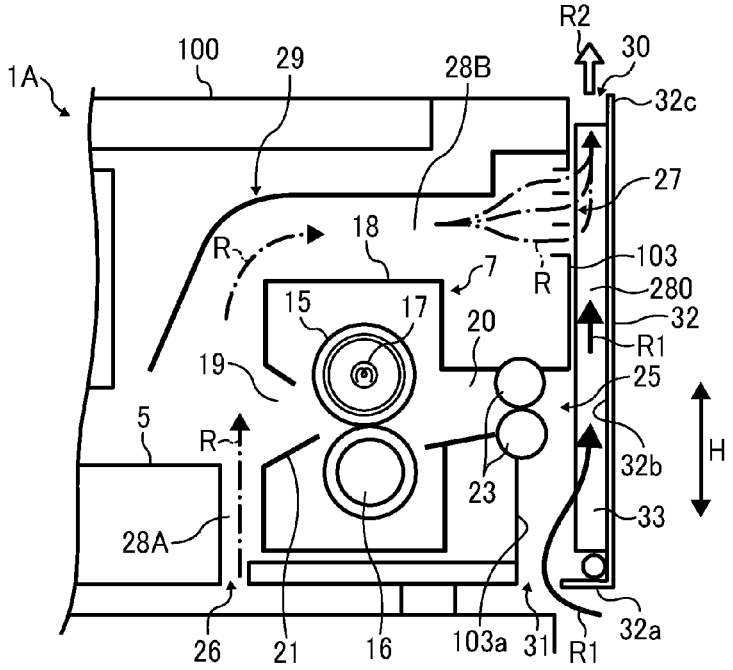
FIG. 5 is a partial vertical sectional view of the image forming apparatus shown in FIG. 4 in a state in which an output tray incorporated therein is closed.

With reference to FIGS. 4 and 5, a description is provided of a configuration of an image forming apparatus 1A incorporating an output tray 32 instead of the front cover 24 shown in FIGS. 1 to 3.

FIG. 4 is a schematic vertical sectional view of the image forming apparatus 1A. FIG. 5 is a partial vertical sectional view of the image forming apparatus 1A in a state in which the output tray 32 is closed. The image forming apparatus 1A has a configuration equivalent to that of the image forming apparatus 1 shown in FIG. 1 except the output tray 32.

The output tray 32 is pivotable about the shaft 105 mounted on the lower part of the body 100 below the sheet outlet 25 in such a manner that the output tray 32 is openable from and closable to the body 100. For example, when the image forming apparatus 1A is in operation, the output tray 32 is opened at an open position indicated by the solid line in FIG. 4. Conversely, when the image forming apparatus 1A is not in operation, the output tray 32 is closed at a close position indicated by the broken line in FIG. 4. When the output tray 32 is closed as shown in the broken line in FIG. 4, it decreases space it occupies and the sheet outlet 25 and the hot air outlet 27 produced through the front plate 103 are not exposed to the user, enhancing the appearance of the image forming apparatus 1A.

When the output tray 32 is opened as shown in the solid line in FIG. 4, the output tray 32 receives a sheet P bearing a toner image discharged by the output roller pair 23 through the sheet outlet 25. The output tray 32 mounts a plurality of primary ribs 33 extending from the shaft 105 in a sheet output direction B when the output tray 32 is opened. As shown in FIG. 5, each primary rib 33 projects from an interior face 32*b* of the output tray 32 disposed opposite the hot air outlet 27 when the output tray 32 is closed. The plurality of primary ribs 33 decreases an area where the sheet P discharged through the sheet outlet 25 contacts the output tray 32, decreasing frictional resistance between the output tray 32 and the sheet P sliding thereover and thus facilitating smooth output of the sheet P onto the output tray 32. As shown in FIG. 4, each primary rib 33 has a height h from the interior face 32*b* of the output tray 32 that creates space between the interior face 32*b* and the sheet P, facilitating pickup of the sheet P from the output tray 32 by the user.

With reference to FIG. 5, a description is provided of airflow inside the image forming apparatus 1A when the output tray 32 is closed.

The airflow inside the body 100 is indicated by the arrows R. Like the front cover 24 depicted in FIG. 3, an orthogonal plate 32*a* projects from the interior face 32*b* of the output tray 32 and the outside air inlet 31 is interposed between the orthogonal plate 32*a* and the exterior face 103*a* of the front plate 103 at a position below the sheet outlet 25. Accordingly, the air current channel 280 is created between the interior face 32*b* of the output tray 32 and the exterior face 103*a* of the front plate 103 and extends in the vertical direction H, thus facing the hot air outlet 27. Since both ends of the output tray 32 in the vertical direction H, that is, the outside air inlet 31 and the vent 30, are in communication with the outside of the image forming apparatus 1A to take in outside air from the outside of the image forming apparatus 1A, hot air discharged through the hot air outlet 27 generates an upward air current in the air current channel 280 that exhausts the hot air to the outside of the image forming apparatus 1A through the vent 30 efficiently.

As described above, negative pressure generated by the upward air current of the hot air discharged through the hot air outlet 27 takes in outside air through the outside air inlet 31. The outside air travels through the vertical air current channel 280 and moves the hot air discharged through the hot air outlet 27 upward to the vent 30 through which the hot air is exhausted to the outside of the image forming apparatus 1A. Accordingly, the hot air discharged through the hot air outlet 27 moves smoothly toward the vent 30 compared to a configuration in which an outside air inlet penetrating the output tray 32 takes in outside air from the outside of the image forming apparatus 1A. Consequently, the hot air is exhausted through the vent 30 efficiently. Further, the outside air inlet 31 is created between the front plate 103 produced with the hot air outlet 27 and the orthogonal plate 32*a* orthogonal to the interior face 32*b* of the output tray 32, facilitating movement of outside air along the exterior face 103*a* of the front plate 103 in the outside air traveling direction R1 and therefore minimizing temperature increase of the front plate 103. Additionally, the outside air taken in through the outside air inlet 31, as it travels through the air current channel 280 in the outside air traveling direction R1, moves over the output roller pair 23 heated by the sheet P heated by the fixing device 7 and its peripheral components, thus minimizing temperature increase of these components.

Figure 6:
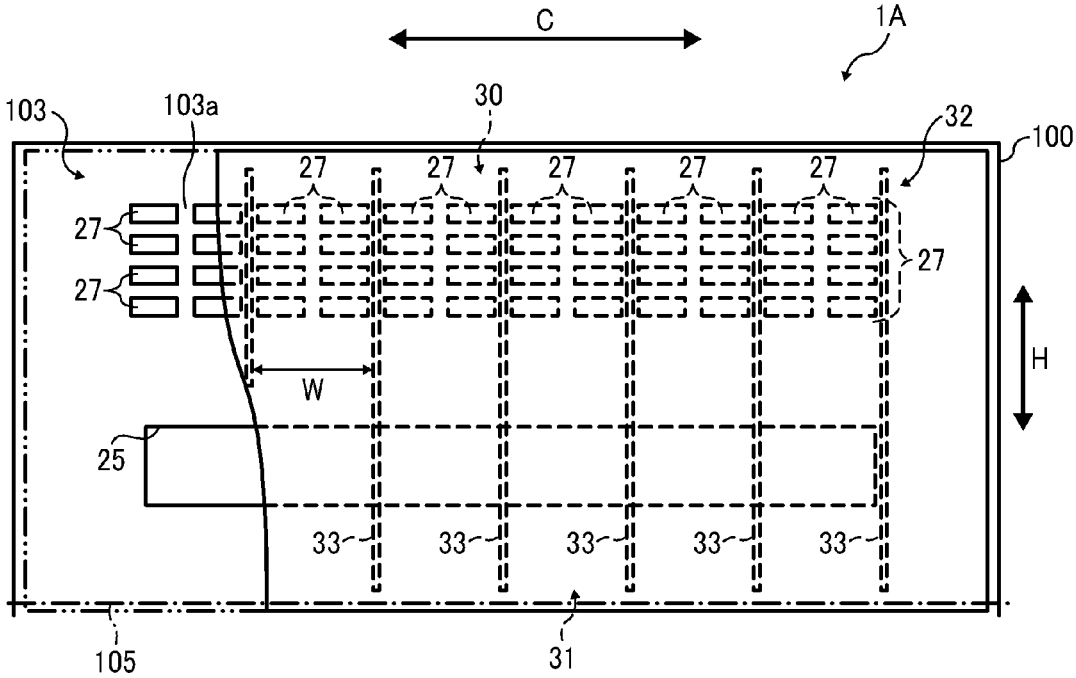
FIG. 6 is a vertical front view of the image forming apparatus shown in FIG. 4 illustrating the output tray and hot air outlets incorporated therein.

With reference to FIG. 6, a detailed description is now given of a construction of the hot air outlets 27.

FIG. 6 is a vertical front view of the image forming apparatus 1A illustrating the output tray 32 and the hot air outlets 27. As shown in FIG. 6, a plurality of hot air outlets 27 is aligned in both vertical direction H and horizontal direction C. According to this example embodiment, four hot air outlets 27 are aligned in the vertical direction H and twelve hot air outlets 27 are aligned in the horizontal direction C, that is, a width direction of the body 100 and a direction orthogonal to the outside air traveling direction R1. However, the number of the hot air outlets 27 aligned in the vertical direction H and the horizontal direction C is not limited to those shown in FIG. 6.

With reference to FIGS. 4 to 9, a detailed description is now given of a construction of the plurality of primary ribs 33.

Since the plurality of primary ribs 33 mounted on the output tray 32 extends from the shaft 105 in the sheet output direction B as shown in FIG. 4, as the output tray 32 is closed as shown in FIG. 5, the plurality of primary ribs 33 extends in the vertical direction H. Since the plurality of primary ribs 33 is aligned in parallel to each other in the horizontal direction C with an interval W between the adjacent primary ribs 33 as shown in FIG. 6, as the output tray 32 is closed as shown in FIG. 5, the air current channel 280 is divided into a plurality of compartments in the horizontal direction C.

Figure 7:
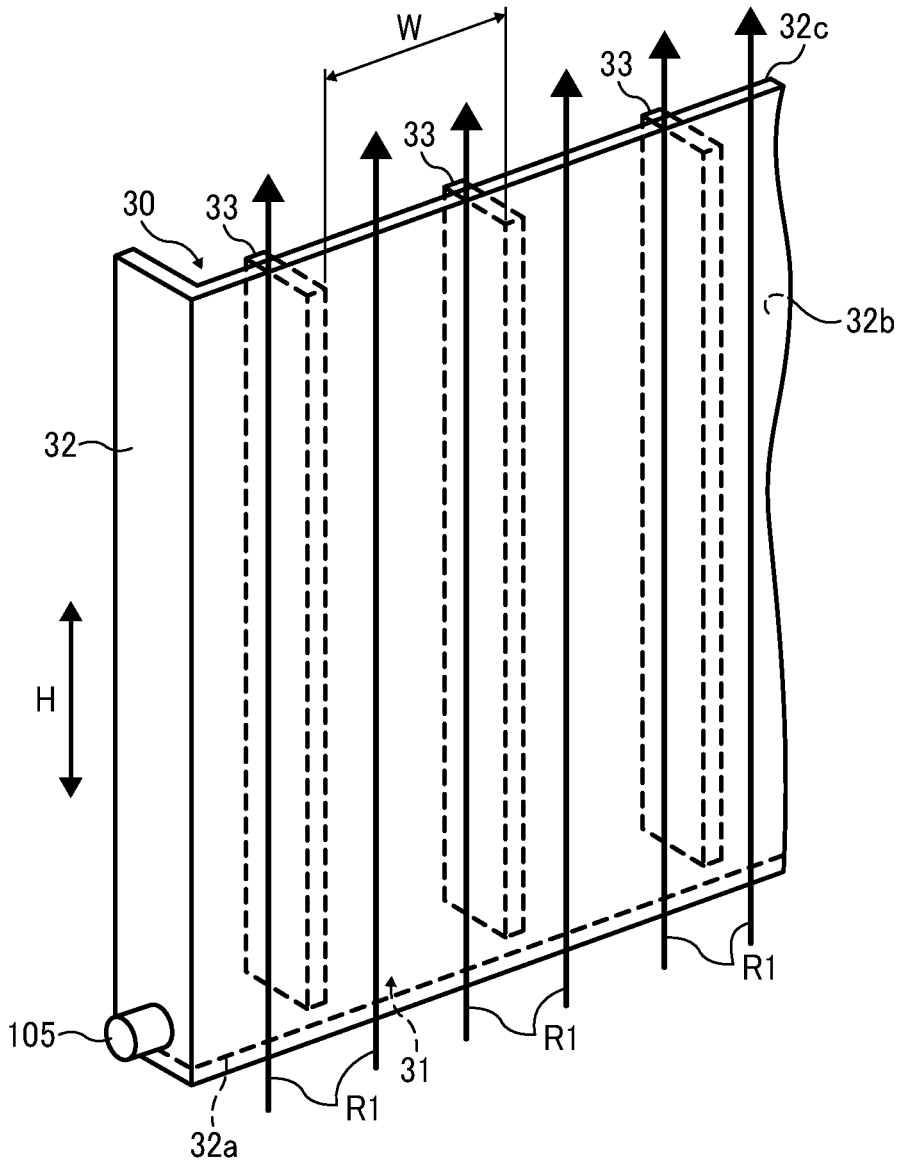
FIG. 7 is a perspective view of the output tray shown in FIG. 6 and primary ribs mounted thereon.

FIG. 7 is a perspective view of the output tray 32 and the primary ribs 33 mounted thereon. As shown in FIG. 7, outside air taken in through the outside air inlet 31 travels through the interval W between the adjacent primary ribs 33 toward the vent 30 in the outside air traveling direction R1 parallel to the vertical direction H by passing in front of the hot air outlets 27 depicted in FIG. 6 Accordingly, the primary ribs 33 facilitate smooth movement of the outside air that is mixed with hot air discharged through the hot air outlets 27 and conveys the hot air to the outside of the image forming apparatus 1A efficiently. Consequently, the primary ribs 33 prevent overheating of the output tray 32, the front plate 103, the output roller pair 23, and its peripheral components effectively.

As shown in FIG. 6, each primary rib 33 is disposed opposite a gap between the adjacent hot air outlets 27, that is, the exterior face 103*a* of the front plate 103 interposed between the adjacent hot air outlets 27 in the horizontal direction C. Accordingly, the primary ribs 33 generate an upward air current that travels in front of the hot air outlets 27 effectively. Additionally, the primary ribs 33 do not overlap the hot air outlets 27, facilitating smooth movement of outside air mixed with hot air discharged through the hot air outlets 27 in the outside air traveling direction R1 toward the vent 30.

As shown in FIGS. 5 and 6, the primary ribs 33 having an identical length in the vertical direction H are aligned within an identical vertical region in the vertical direction H. However, the length and location of the primary ribs 33 in the vertical direction H are not limited to those shown in FIG. 6. For example, two types of ribs having different lengths may be aligned as shown in FIG. 8.

Figure 8:
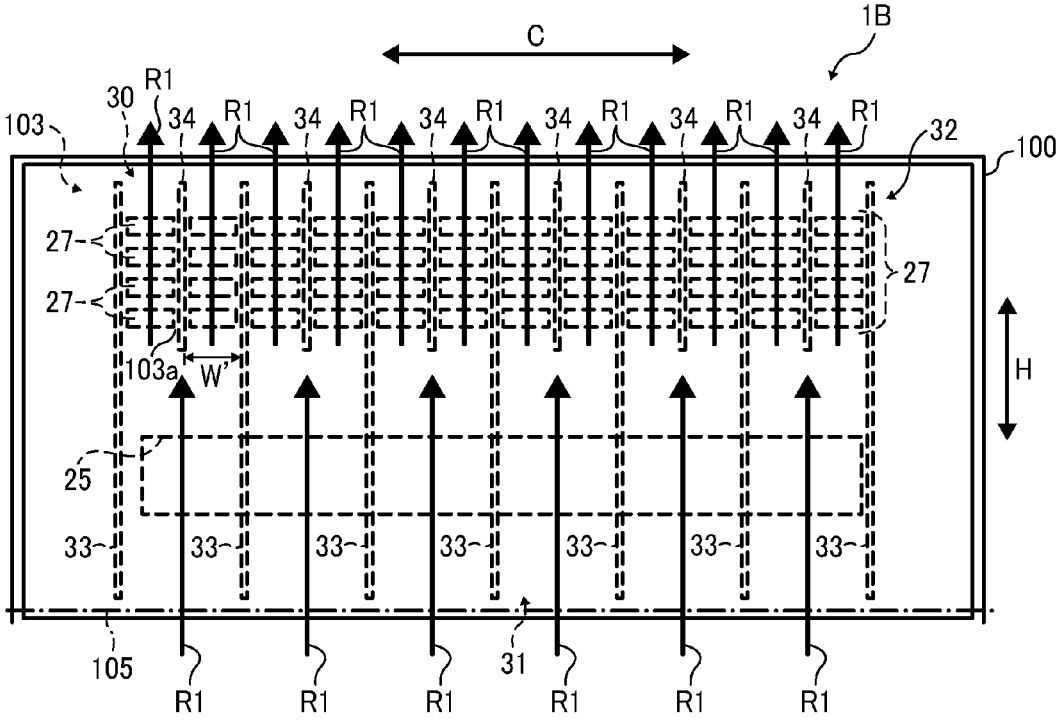
FIG. 8 is a vertical front view of an image forming apparatus according to yet another example embodiment of the present invention.

FIG. 8 is a vertical front view of an image forming apparatus 1B incorporating the plurality of primary ribs 33 and a plurality of secondary ribs 34 having a length in the vertical direction H different from that of the primary ribs 33. As shown in FIG. 8, each secondary rib 34 having a reduced length in the vertical direction H is interposed between the adjacent primary ribs 33 in the horizontal direction C. That is, the longer primary ribs 33 and the shorter secondary ribs 34 are aligned alternately. Similar to the primary ribs 33, each secondary rib 34 is disposed opposite a gap between the adjacent hot air outlets 27, that is, the exterior face 103*a* of the front plate 103 interposed between the adjacent hot air outlets 27 in the horizontal direction C.

The increased number of the primary ribs 33 and the secondary ribs 34 situated in proximity to the hot air outlets 27 increases the number of divided compartments in the air current channel 280 situated in proximity to the hot air outlets 27, increasing the speed of outside air moving in front of the hot air outlets 27 and thereby efficiently exhausting hot air discharged through the hot air outlets 27 and mixed with the outside air through the vent 30 to the outside of the image forming apparatus 1B. The output tray 32 mounting the secondary ribs 34 in addition to the primary ribs 33, with a predetermined cross-sectional area of the air current channel 280 created by the output tray 32, the primary ribs 33, and the secondary ribs 34, produces a reduced interval W' between the adjacent primary rib 33 and the secondary rib 34 compared to the output tray 32 mounting the primary ribs 33 only, isolating each hot air outlet 27 from the adjacent hot air outlet 27 in the horizontal direction C and isolating each divided compartment on the interior face 32*b* of the output tray 32 from the adjacent compartment thereon in the horizontal direction C, which is disposed opposite each hot air outlet 27. Accordingly, overheating of the output tray 32 is minimized efficiently without degrading ventilation.

Figure 9:
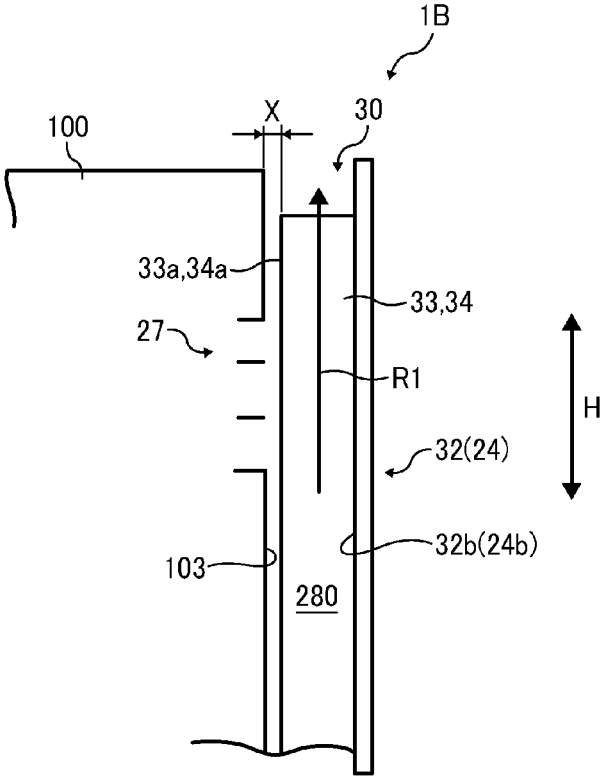
FIG. 9 is a partially enlarged vertical sectional view of the output tray and a body incorporated in the image forming apparatus shown in FIG. 8.

With reference to FIG. 9, a description is provided of a gap between the front plate 103 and each rib, that is, the primary rib 33 and the secondary rib 34. FIG. 9 is a partially enlarged vertical sectional view of the output tray 32 and the body 100 of the image forming apparatus 1B. As shown in FIG. 9, a predetermined interval X is provided between the front plate 103 and opposed edges 33*a* and 34*a* of the primary rib 33 and the secondary rib 34 mounted on the interior face 32*b* of the output tray 32 in a direction orthogonal to the vertical direction H. Similarly, the predetermined interval X is provided between the front plate 103 and the opposed edges 33*a* and 34*a* of the primary rib 33 and the secondary rib 34 mounted on the interior face 24*b* of the front cover 24 in the direction orthogonal to the vertical direction H.

According to the configuration shown in FIG. 8, the primary ribs 33 and the secondary ribs 34 having different lengths, respectively, are aligned in parallel to each other in the horizontal direction C and extended in the vertical direction H. Alternatively, in order to narrow the gap between the adjacent ribs, the increased number of the primary ribs 33 having an identical length in the vertical direction H may be aligned in parallel to each other. In this case, since the primary ribs 33 of an identical shape are mounted on the output tray 32, the primary ribs 33 are molded with the output tray 32 at reduced manufacturing costs. Alternatively, the primary ribs 33 may be combined with the output tray 32 after being shaped separately, decreasing the number of variant primary ribs 33 and therefore reducing manufacturing costs.

As shown in FIG. 8, the secondary ribs 34 are mounted on the interior face 32*b* of the output tray 32 disposed opposite the hot air outlets 27. Alternatively, the secondary ribs 34 may be mounted on a gap between the adjacent hot air outlets 27, that is, the exterior face 103*a* of the front plate 103 interposed between the adjacent hot air outlets 27 in the horizontal direction C. In this case, each secondary rib 34 may be a reinforcement that reinforces the front plate 103 at a position in proximity to the hot air outlets 27.

It is to be noted that the primary ribs 33 and the secondary ribs 34 may also be mounted on the front cover 24 depicted in FIG. 1, attaining the advantages described above.

As shown in FIGS. 3, 5, and 8, the image forming apparatuses 1, 1A, and 1B incorporate the at least one hot air outlet 27 through which hot air produced by the fixing device 7 is discharged to the outside of the image forming apparatuses 1, 1A, and 1B by natural ventilation. A cover (e.g., the front cover 24 and the output tray 32) is disposed opposite the hot air outlet 27 if the cover is closed when the image forming apparatuses 1, 1A, and 1B are not in operation. Below the hot air outlet 27 is the outside air inlet 31 interposed between an orthogonal plate (e.g., the orthogonal plates 24*a* and 32*a*) of the cover and a body plate (e.g., the front plate 103) produced with the hot air outlet 27. The orthogonal plate projects from a lower edge of the cover orthogonally. The outside air inlet 31 is in communication with the air current channel 280 that is in communication with the vent 30 interposed between the body plate and an upper edge of the cover. Hot air discharged through the hot air outlet 27 generates an upward air current between the hot air outlet 27 and the cover by the chimney effect, which exhausts the hot air discharged through the hot air outlet 27 to the outside of the image forming apparatuses 1, 1A, and 1B through the vent 30.

The image forming apparatuses 1, 1A, and 1B include the cover mounting the orthogonal plate projecting therefrom orthogonally toward the body plate produced with the hot air outlet 27 in such a manner that the orthogonal plate is orthogonal to the body plate. When the cover is closed, the outside air inlet 31 is created between the orthogonal plate mounted on the cover and the body plate at a position upstream from the hot air outlet 27 in the outside air traveling direction R1. The outside air inlet 31 is in communication with the air current channel 280 that is in communication with the vent 30 created between the cover and the body plate at a position downstream from the hot air outlet 27 in the outside air traveling direction R1. Although the cover is disposed opposite the hot air outlet 27, hot air discharged through the hot air outlet 27 generates an upward air current in the air current channel 280 that takes in outside air through the outside air inlet 31 which travels through the air current channel 280 in the outside air traveling direction R1 toward the vent 30.

Unlike a conventional configuration in which an outside air inlet is produced in the cover at a position disposed opposite the hot air outlet 27, the outside air inlet 31 takes in outside air that travels through the air current channel 280 to the vent 30 smoothly. Accordingly, hot air discharged through the hot air outlet 27 is exhausted through the air current channel 280 and the vent 30 efficiently, minimizing overheating of the cover due to heat discharged through the hot air outlet 27 with the enhanced appearance of the image forming apparatuses 1, 1A, and 1B.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image forming apparatus comprising:

a body plate;

a cover disposed opposite the body plate;

an orthogonal plate projecting from a lower edge of the cover orthogonally toward the body plate;

an outside air inlet created between the orthogonal plate and the body plate, through which outside air is taken in, the outside air inlet being disposed in a plane extending along a surface of the orthogonal plate while the cover is closed;

a vent created between the body plate and the cover at an upper edge of the cover;

an air current channel in communication with the outside air inlet and the vent, the air current channel through which the outside air taken in through the outside air inlet travels upward to the vent in an outside air traveling direction; and at least one hot air outlet produced through the body plate at a position between the outside air inlet and the vent in the outside air traveling direction, the at least one hot air outlet through which hot air is discharged into the air current channel;

a plurality of primary ribs mounted on an interior face of the cover disposed opposite the body plate and having a first length extending in the outside air traveling direction;

a plurality of secondary ribs mounted on an exterior face of the body plate and having a second length extending in the outside air traveling direction smaller than the first length of the plurality of primary ribs, wherein the at least one hot air outlet includes a plurality of hot air outlets aligned in parallel to each other and each of the plurality of secondary ribs is disposed at a gap between adjacent hot air outlets, wherein each of the plurality of secondary ribs is interposed between the adjacent primary ribs in a direction orthogonal to the outside air traveling direction, and wherein the outside air taken in through the outside air inlet is mixed with the hot air discharged through the at least one hot air outlet and is exhausted through the vent.

2. The image forming apparatus according to claim 1, wherein the plurality of primary ribs is aligned in parallel to each other with a first interval between adjacent primary ribs in a direction orthogonal to the outside air traveling direction, the first interval through which the outside air travels upward in the outside air traveling direction from the outside air inlet to the vent.

3. The image forming apparatus according to claim 1, wherein each of the plurality of primary ribs is disposed opposite a gap between adjacent hot air outlets in a direction orthogonal to the outside air traveling direction.

4. The image forming apparatus according to claim 1, wherein the second length of the plurality of secondary ribs corresponds to a third length of the plurality of hot air outlets in the outside air traveling direction.

5. The image forming apparatus according to claim 1, wherein a set second interval is provided between the body plate and the plurality of primary ribs and secondary ribs mounted on the cover in the direction orthogonal to the outside air traveling direction.

6. The image forming apparatus according to claim 1, further comprising:

a recording medium outlet disposed upstream from the at least one hot air outlet in the outside air traveling direction, the recording medium outlet through which a recording medium bearing a toner image is discharged; and a shaft attached to a lower end of the cover disposed upstream from the recording medium outlet in the outside air traveling direction, the shaft pivotably supporting the cover, wherein the cover pivots about the shaft and is opened to receive the recording medium discharged through the recording medium outlet.

* * * * *